US006782639B1

(12) United States Patent
Müller

(10) Patent No.: US 6,782,639 B1
(45) Date of Patent: Aug. 31, 2004

(54) FOOTWEAR FOR A DYNAMIC, ROLLING WALKING-ACTION

(75) Inventor: Karl Müller, Roggwill (CH)

(73) Assignee: Negort AG, Roggwill (CH)

( * ) Notice: Subject to any disclaimer, the term of this patent is extended or adjusted under 35 U.S.C. 154(b) by 0 days.

(21) Appl. No.: 09/787,486

(22) PCT Filed: Jul. 31, 2000

(86) PCT No.: PCT/CH00/00412

§ 371 (c)(1),
(2), (4) Date: Jun. 14, 2001

(87) PCT Pub. No.: WO01/15560

PCT Pub. Date: Mar. 8, 2001

(30) Foreign Application Priority Data

Aug. 28, 1999 (CH) ..... 1572/99
Apr. 6, 2000 (CH) ..... 0686/00

(51) Int. Cl.[7] ..... A43B 13/18; A43B 13/00; A43B 5/04

(52) U.S. Cl. ..... 36/28; 36/30 R; 36/117.4; 36/103

(58) Field of Search ..... 36/25 R, 28, 30 R, 36/32, 103, 110, 114, 117.4, 117.3, 132

(56) References Cited

U.S. PATENT DOCUMENTS 2,012,172 A * 8/1935 Mitchell ..... 36/30 R
4,030,213 A 6/1977 Daswick
4,155,180 A * 5/1979 Phillips ..... 36/103
4,294,024 A * 10/1981 Nab ..... 36/67 D
4,372,059 A 2/1983 Ambrose
RE31,173 E * 3/1983 Daswick ..... 36/30 R
5,537,762 A * 7/1996 Walters ..... 36/28
5,579,591 A * 12/1996 Kousaka et al. ..... 36/25 R
5,586,398 A 12/1996 Carlson
5,592,757 A * 1/1997 Jackinsky ..... 36/114
5,761,834 A * 6/1998 Grim et al. ..... 36/110
6,158,151 A * 12/2000 Won ..... 36/103
6,341,432 B1 1/2002 Muller

FOREIGN PATENT DOCUMENTS

WO WO9903368 1/1999

* cited by examiner

*Primary Examiner*—Anthony D. Stashick
(74) *Attorney, Agent, or Firm*—Marshall, Gerstein & Borun LLP

(57) ABSTRACT

A device for active rolling walking (1) includes a conventional upper shoe (2) used for fixing the device to the foot, which upper shoe can be made from leather, textiles or other natural or synthetic materials, and a specially constructed sole to force active, rolling walking to take place and can be adapted to all possible circumstances. The structure of the sole and the choice of material gives the user, when rolling, the feeling of walking bare foot in the sand with a trampoline effect.

5 Claims, 4 Drawing Sheets

1
2
10
11
13
12

1
2
10
11
13
12

1
2
10
11
13
12

B
A
1
2
I
v
10
11
z,z'
3
b,b'
a,a'
d
15
12
13
14
14
15
x,x'
y,y'
II
III
IV
B
A

P'

A -A
15
Q
Q'
R°
a
a'
x
y
x'
m
P
n

P'

A -A
15
Q
Q'
R°
a
a'
x
y
y'
x'
P

P'

A -A
15
Q
Q'
R°
a
a'
x
x'
y
P

FOOTWEAR FOR A DYNAMIC, ROLLING WALKING-ACTION

FIELD OF THE INVENTION

The present invention relates to a device for active rolling walking.

BACKGROUND OF THE INVENTION

The human being with his highly complicated ligament-muscle-tendon system and the sensitive, upright spinal column is built so that in nature he can advance on uneven ground. For thousands of years the human being has used and maintained his body in accordance with this natural condition.

Only over the last hundred years have we started to a significant extent to make the ground surfaces on which we live and move artificially flat and hard. When we move on such surfaces the body is used in a completely different manner from that intended by nature and precisely over this short period of human history problems have started to spread in epidemic manner in connection with the back, joints, veins, etc.

A few thousand years ago man discovered the wheel for the transportation of goods. He realized at the time that this constitutes a practical means for transporting heavy loads over considerable distances. The flatter the transportation routes, the easier transportation takes place. As a consequence he has adapted the transportation routes to the wheel and made them flat.

When about 100 years ago man started to make largely flat ground surfaces in the area where he was moving about he should, in accordance with the development with the wheel and in opposition to his walking system, have at least redesigned his footwear, namely in such a way that he can also "roll" on flat ground surfaces. Only in this way is it possible to maintain the natural stride when walking and therefore the health of the locomotor system. However, the shoe industry completely missed this development.

It is admittedly easier for humans to walk on flat ground surfaces and in fact it is so easy that it permits passive walking for which only parts of the locomotor system are needed and has in fact enticed him towards passive walking. The consequence is shocks in the joints and on the spinal column. Unequal stressing of the locomotor system means that certain parts thereof are not stressed, whereas others are excessively stressed. The 10,000 steps made by a human on average every day challenge the human body. In the case of disadvantageous, unilateral stressing of the locomotor system, such as results from passive walking, shocks in the joints and unilateral muscle, tendon and ligament stresses give rise to widespread back, joint, vein, leg and foot problems.

The normal shoes with a heel have not been adapted to the walking situation on flat surfaces. Foot supports in the shoe and softer soles permitting a type of bare-foot walking are available on the market, but a shoe forcing the human to a planned, active use of his locomotor system and therefore simulating the unevenness of the ground important for it does not exist.

Slight disabilities or postural damage such as skew or flat feet are treated e.g. with inserts in normal shoes. It is assumed that as a result of the continuous use or wearing of inserts the desired correction is automatically brought about over a period of time. Unfortunately the opposite is the case and the relaxed muscle system is weakened, because it no longer has any work function. The dynamic change and further development of the state of the posture and locomotor system is not or is only slightly taken into account.

In the case of slight disabilities frequently a continuously used measure such as, e.g. the wearing of inserts, is unfavourable. It is very easy for the wearer wishing to correct an incorrect posture to adopt a different, new incorrect posture as a result of the static correction.

Neither shoes, nor the above-described walking devices, also referred to in numerous articles and patents, take account of the need to use the complete locomotor system through active walking and to be able to determine oneself and quickly in what way muscles, tendons and the spinal column are to be employed for active walking. Both orthopedic shoes and inserts can only be modified by an orthopedic expert. Consequently the existing means are unsuitable for conditioning slight and possibly also temporary postural errors and errors in the sequence of the locomotor system in a planned and rapid manner.

Physiotherapy is often a help in giving instructions for corresponding exercises and movements. However, this often has the disadvantage that therapy cannot take place permanently, i.e. also during normal walking at work and so on and the patient often does not carry out the few exercises recommended.

SUMMARY OF THE INVENTION

The problem of the present invention is to improve a shoe or other footwear of the aforementioned type in such a way that active walking becomes necessary. As a result the 10,000 steps performed daily are made into a natural, rolling coordinated movement. Uniform stressing of the complete body protects the joints, builds up muscles, straightens the posture and aids blood circulation ("vein pump"). The device for active rolling walking is to be prepared by the expert and can be adapted by the actual user.

This problem is solved by a device for active rolling walking having the features of the present invention.

BRIEF DESCRIPTION OF THE DRAWINGS

The advantages are illustrated in the following description.

In the drawings show.

DETAILED DESCRIPTION OF THE PREFERRED EMBODIMENT

Figure 1:
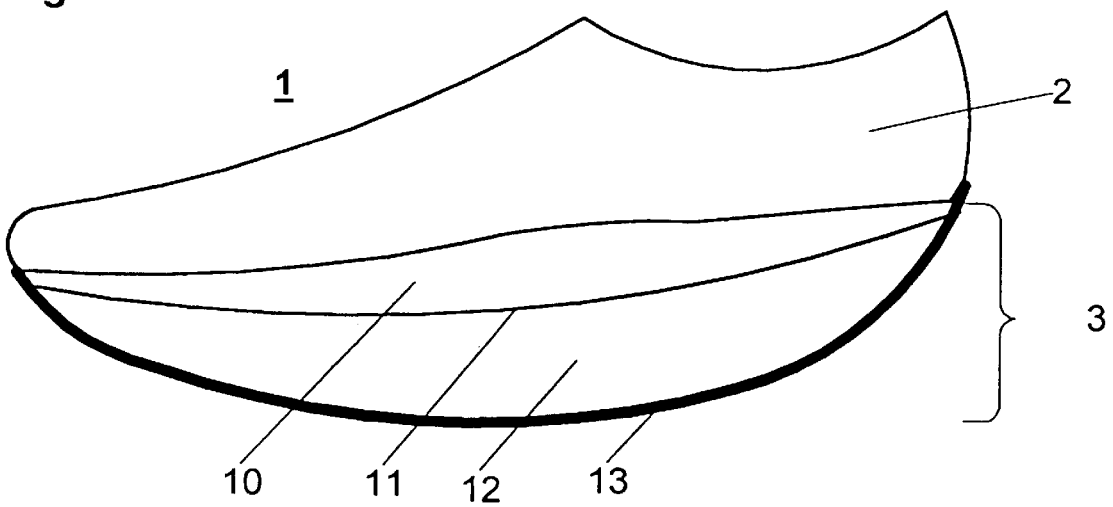
FIG. 1 A device for active rolling walking.

The drawings show preferred embodiments illustrated by the following description.

A device according to the invention for active rolling walking 1, hereinafter called walking device 1, comprises an upper shoe 2 and a sole 3. The upper shoe 2 is used for the reliable fixing of the walking device 1 to the foot. This can take place by means of straps, such as are used for sandals, laces as are used in the case of beach shoes or an entire upper shoe made from leather or a textile material. What is important is that through said upper shoe 2 the foot is firmly and comfortably connected to the midsole 10.

The sole 3 can be constructed in different ways. It fundamentally comprises at least one midsole 10, undersole 12 and sole bottom 13. To increase the flexibility of the walking device 1, a midsole bottom 11 can be incorporated between the midsole 10 and undersole 12. The use and application decide how a walking device 1 according to the invention is constructed and this constitutes one of the advantages thereof. It is adapted to the needs of a group of use aims, but can still be individually adjusted.

The midsole 10 is made from conventional material and is relatively hard. It is adapted to the intended use, so that for a gym shoe a different hardness, i.e. a different material is chosen as compared with e.g. a workday shoe. The midsole bottom 11 is made from hard elastic material. It also has an adequate strength to absorb the forces resulting from the deformation of the undersole 12. The midsole bottom 11 is stable enough to be able to reliably carry the nap or stud-like, hard inclusions 15. The lower boundary of the midsole 10 or, if present, the midsole bottom 11 has a downwardly convex, arcuate or circular segmental, random shape, which is chosen as a function of the intended use of the walking device 1.

Figure 3:
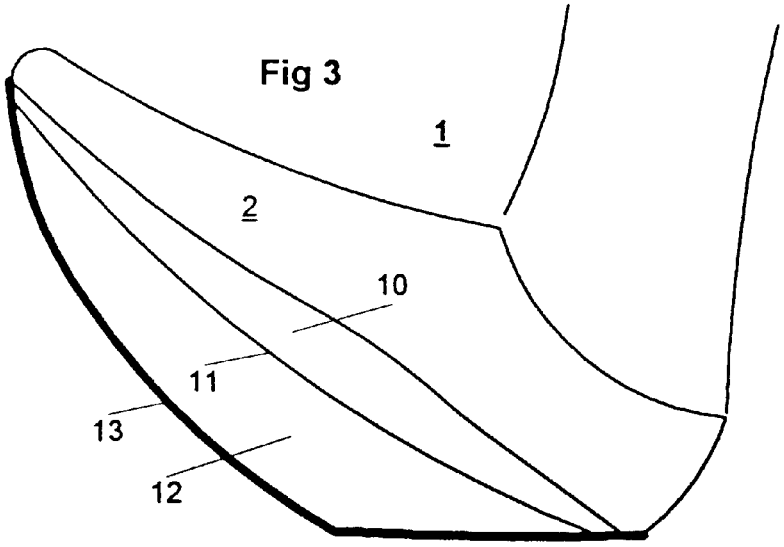
FIG. 3 An instant photograph in the sequence of a device for active rolling walking.
Figure 4:
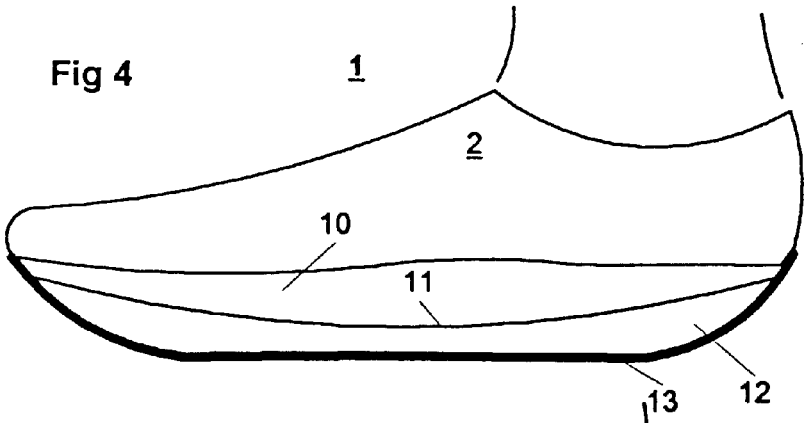
FIG. 4 An instant photograph in the sequence of a device for active rolling walking.
Figure 5:
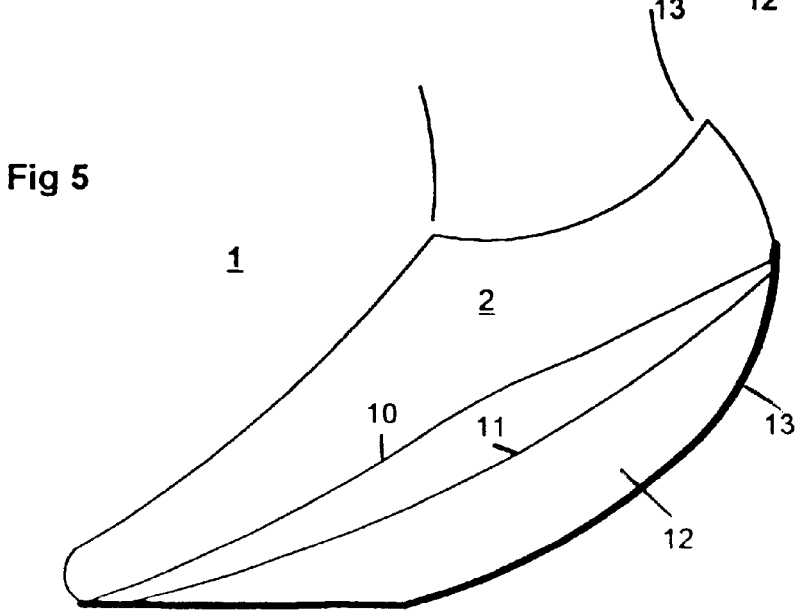
FIG. 5 An instant photograph in the sequence of a device for active rolling walking.

The undersole 12 is the most important part of the walking device. It has on the side against the terminating sole bottom 13 a downward convex, arcuate or circular segmental, random shape. It is made from highly deformable, flexible material, which gives the user when rolling a feeling of bare foot walking in the sand with a trampoline effect. The rolling process, as is chronologically represented in FIGS. 3, 4 and 5, requires a certain active force expenditure in the same way as when walking on sand. In the final rolling phase, as shown in FIG. 5, the rolling process is terminated by a type of trampoline effect. The sole bottom 13 mainly serves to protect the undersole 12 against wear and gives the walking device 1 the necessary slip resistance. Made from highly resilient and abrasion-resistant, elastic material, it immediately collapses on rolling. Thus, during rolling it is constantly adapted to the above-described shape of the undersole 12. As a function of needs, suitable means are applied to the sole bottom 13 to enable an individual, uncomplicated fixing of the studs 14.

Any random type of adaptation is made possible by the inventive construction of the sole 3 from the midsole 10, midsole bottom 11, undersole 12 and sole bottom 13. For planned uses and applications, such as massage, foot-leg correction, statics of the spinal column, foot reflex, etc., the midsole 10 and undersole 12 can be moulded from one piece. The transition from the relatively hard midsole 10 to the soft elastic undersole 12 is in many cases of a progressive nature. During production this production method offers significant advantages. The sole 3 is terminated by a sole bottom 13, which has the aforementioned convex shape.

The undersole 12 can be formed from layers or different parts. It is e.g. conceivable that on treading (FIG. 3) in the rear third of the sole 3 is chosen a first composition of the mixture, in the middle third of the sole (FIG. 4) a second and in the front third (FIG. 5) a third composition. The aim of the rolling movement is decisive for the choice of the compositions and the structure of the sole 3. Materials are chosen, which are highly deformable and flexible, but which ensure a good recovery effect.

Figure 2:
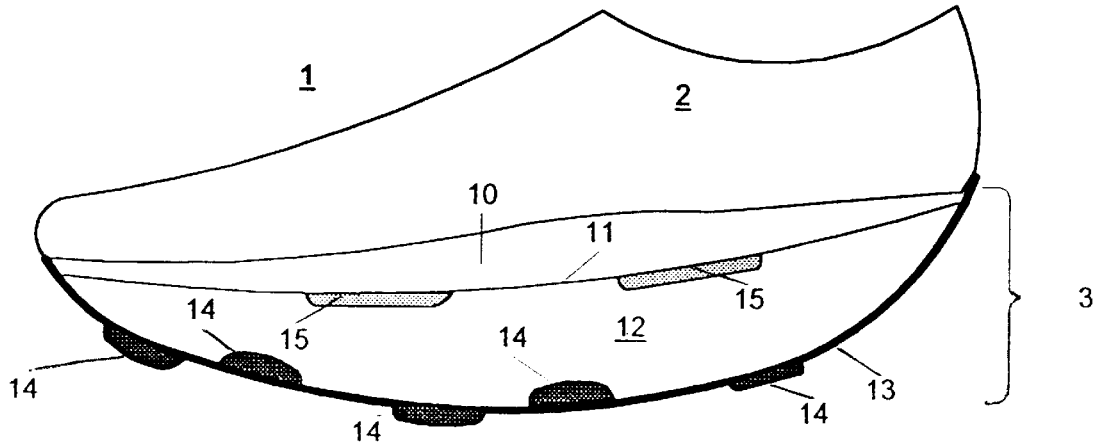
FIG. 2 A device for active rolling walking with additives.

More specifically for orthopedic uses the possibility shown in FIG. 2 of being able to fix hard inclusions 15 to the midsole bottom 11 is appropriate. Such hard inclusions 15 can have a random shape and size. The material chosen can have different hardness and elasticity properties. The choice of the shape, hardness and elasticity are a function of the intended use of the walking device 1. With such hard inclusions 15 it is possible to precorrect incorrect or abnormal postures of feet, such as e.g. in the case of skew or flat feet or abnormal postures of the knee or hip position, as well as spinal column postural deficiencies. However, these hard inclusions 15 also permit massaging effects, the stimulation of foot zone reflexes and the planning of coordinated movements. The walking device 1 can be used for strengthening certain muscles and for the active support of the osseous system.

The studs 14 to be fixed to the sole bottom 13 can be fitted both in fixed and removable manner. If they are to be randomly interchanged in the same way as football boot studs, this offers the user the advantage and possibility of being able to himself adjust certain training effects. The walking device 1 according to the invention consequently becomes a training device, which can be adapted to varying training needs.

The described studs 14 can have a random shape and size. The hardness and elasticity can be adapted to the corresponding use. It is naturally also possible to fit to the sole bottom 13 other members having a random shape, size, elasticity and of different materials. They can either be firmly connected or removably fixed to the sole bottom 13.

The sole bottom 13 serves as a termination and protective layer for parts or all the parts of the complete sole 3. It can be placed around the sole 3 and, if desired, be drawn up to the upper shoe 2.

Figure 6:
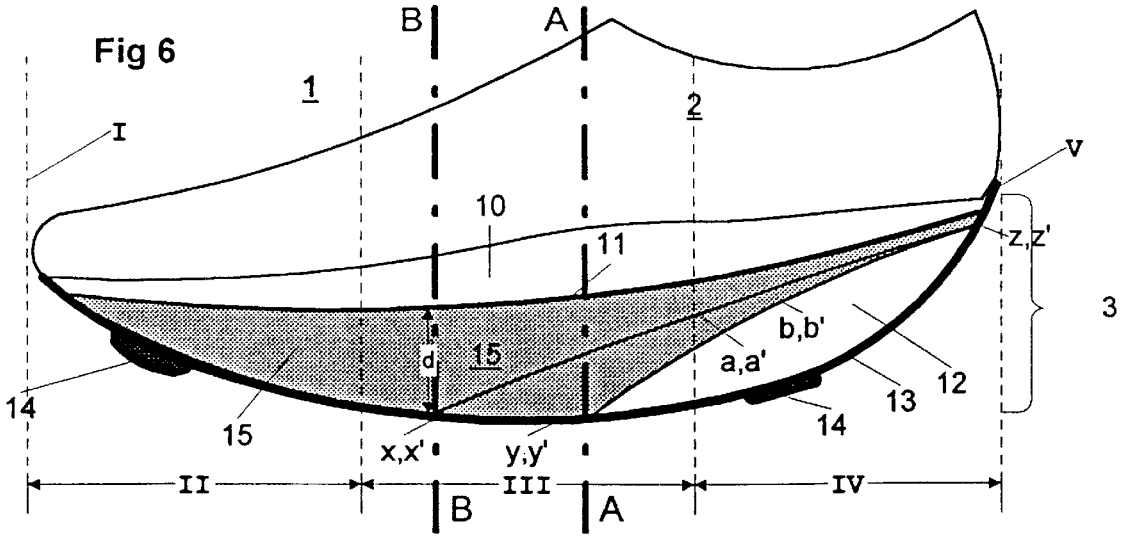
FIG. 6 A lateral section of the device for active rolling walking.
Figure 7:
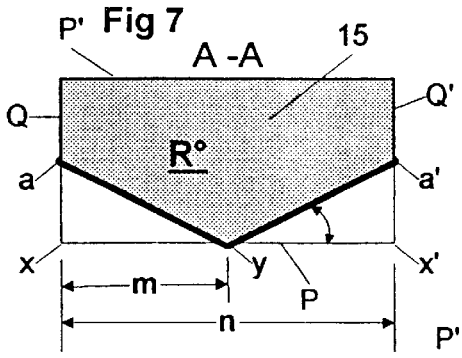
FIG. 7 A sectional view taken at A—A in FIG. 6 viewed from the rear.
Figure 8:
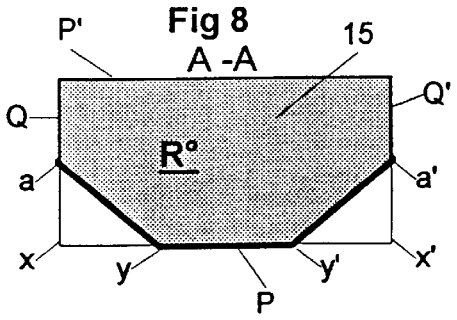
FIG. 8 A sectional view taken at A—A in FIG. 6 viewed from the rear.
Figure 9:
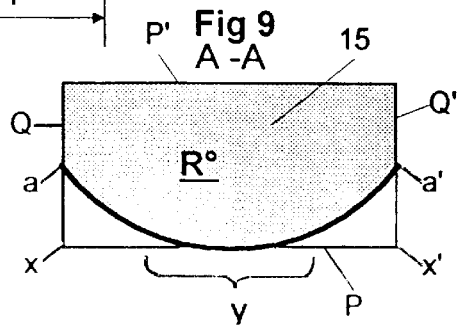
FIG. 9 A sectional view taken at A—A in FIG. 6 viewed from the rear.
Figure 10:
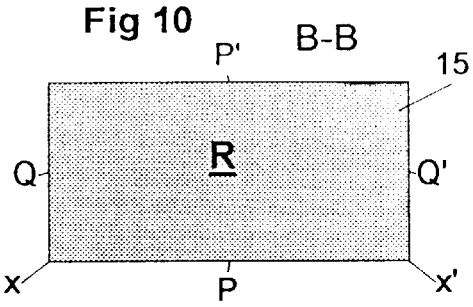
FIG. 10 A sectional view taken at B—B in FIG. 6 viewed from the rear.
Figure 12:
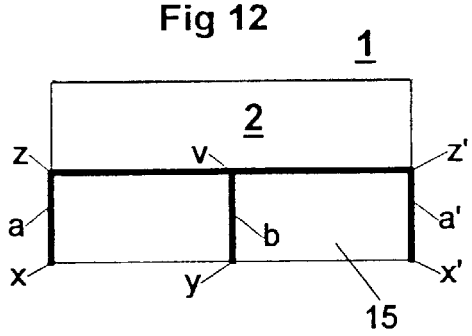
FIG. 12 View of the sole from the rear.
Figure 13:
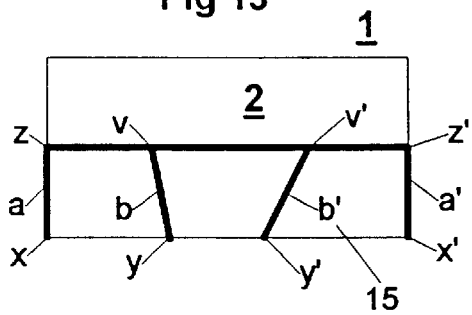
FIG. 13 View of the sole from the rear.
Figure 11:
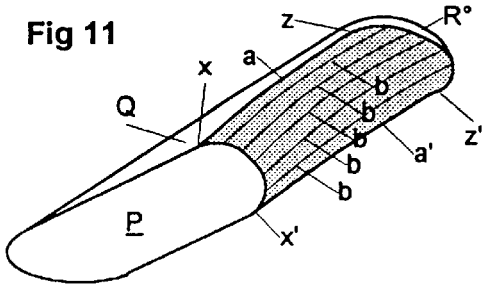
FIG. 11 A perspective and diagrammatic view of the hard inclusion from below.
Figure 14:
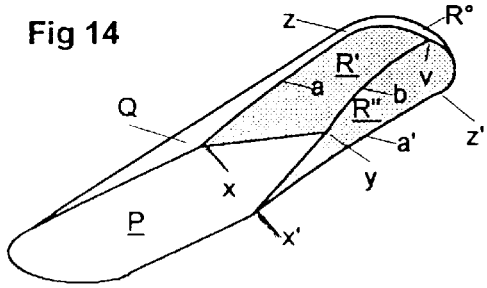
FIG. 14 Perspective view of the hard inclusion from below.

FIG. 6 shows that a hard inclusion 15 can also have large dimensions and fill the entire front part of the sole II. At point x in section B it has a thickness d, which extends in wedge-shaped manner up to the tip I of the walking device 1. The space between the midsole bottom 11 and undersole bottom 13 is completely filled by the hard inclusion 15 shown. All four forwardly directed boundary surfaces P, P', Q and Q' of the wedge can have a random shape and can be adapted to the outer contour of the active rolling walking device 1. The fifth, rearwardly directed surface R of the wedge, which is e.g. represented in section on line B in FIG. 10, is extended in a random shape up to the heel V. FIGS. 11 and 14 show possible embodiments of this part of a hard inclusion 15. As a function of the shape of the rear part of the hard inclusion 15, the shapes of the surfaces P, P', Q and Q' obviously change. The surface R can be bounded by different lines a, a', b and b' and can be subdivided into segments R, R', R", as shown in FIG. 14.

The shape of the hard inclusion 15 in the central section III and in the rear section IV can be chosen at random, as illustrated by FIGS. 7 to 14. Both the outward boundary lines a and a' linking points x and z or x' and z', and the central line b virtually represented as a "comb" in FIG. 14 and which links the points y and v, can have a fundamentally random configuration.

Only in very few cases is line b centrally positioned. Due to the arrangement diverging from the center, a planned, unilateral stressing of the locomotor system and in particular the muscles is obtained for the wearer of the walking device 1.

In order to avoid or reduce the risk of flexing during walking, by means of an infinite curve group b linking an infinite number of points x and y, it is possible to form a round surface R' with a random shape in the manner shown in FIG. 11.

The space between the midsole bottom 11 and undersole bottom 13 is filled by hard inclusions 15 and the soft undersole 12. There are no air inclusions. The hard inclusion 15 and undersole 12 are adapted to one another in such a way that from the outside there is a shape perceptible as a whole and which is terminated by the undersole bottom 13.

What is claimed is:

1. Device for active rolling walking (1) to be worn on a foot of a person, comprising in combination an upper part (2) provided with an upper shoe with which it is possible to fix the device to the foot, and a sole (3) having at least a midsole (10), a midsole bottom (11), undersole (12) and a sole bottom (13), said midsole (10) being strong, hard and elastic, said undersole (12) having a thickness in the range between approximately 0.5 and 5 cm, said undersole being soft and elastic, and said sole bottom (13) being hard and elastic, said midsole bottom (11) and said sole bottom (13) each having a curved shape when unloaded that is substantially continuous and convex, without any abrupt changes in radius of curvature, along substantially the entire length thereof wherein a hard, wedge-shaped inclusion (15) completely fills the space between said midsole bottom (11) and said sole bottom (13) in the front third of the shoe (II), and in the rear two thirds of the shoe (III, IV) has a convex shape, as viewed in cross section transverse to the length of the shoe, and said soft undersole (12) filling the space between said midsole bottom (11) and said sole bottom (13) in such a way that the convex outer contour of said sole bottom (13) is maintained.

2. Device for active rolling walking (1) according to claim 1, wherein there is a progressive transition from said strong, hard midsole (10) to said soft undersole (12).

3. Device for active rolling walking (1) according to claim 1, wherein said undersole (12) is made from one or more layers or parts of soft material, so that said sole (3) has a resilience giving way in the manner of sand, but which in the stressed state can only be brought to a new shape by exerting force and which despite this is elastically flexible.

4. The device of claim 1, wherein said hard, wedge-shaped inclusion (15) has a convex curved shape in the rear two-thirds of the shoe (III, IV).

5. The device of claim 1, wherein said hard, wedge-shaped inclusion (15) has a convex V-shape in the rear two-thirds of the shoe (III, IV).

* * * * *